US011015344B2

(12) United States Patent
Gille

(10) Patent No.: US 11,015,344 B2
(45) Date of Patent: May 25, 2021

(54) CASSETTE FRAME COMPONENTS AND METHODS OF INSTALLATION

(71) Applicant: Tubelite Inc., Walker, MI (US)

(72) Inventor: Steven Gille, Wausau, WI (US)

(73) Assignee: Tubelite Inc., Walker, MI (US)

( * ) Notice: Subject to any disclaimer, the term of this patent is extended or adjusted under 35 U.S.C. 154(b) by 0 days.

(21) Appl. No.: 16/393,522

(22) Filed: Apr. 24, 2019

(65) Prior Publication Data

US 2019/0330844 A1 Oct. 31, 2019

Related U.S. Application Data

(60) Provisional application No. 62/661,835, filed on Apr. 24, 2018.

(51) Int. Cl.

| | |
|---|---|
| ***E04B 2/88*** | (2006.01) |
| ***E06B 3/26*** | (2006.01) |
| ***E06B 3/56*** | (2006.01) |
| ***E06B 3/54*** | (2006.01) |

(52) U.S. Cl.

CPC ..... *E04B 2/885* (2013.01); *E06B 3/26* (2013.01); *E06B 3/5427* (2013.01); *E06B 3/56* (2013.01)

(58) Field of Classification Search

CPC ... E04B 2/90; E04B 2/885; E04B 2/96; E04B 2/88; E04B 2/965; E04B 2/967; E06B 3/26; E06B 3/5427; E06B 3/56; E06B 3/64

USPC ..... 52/235

See application file for complete search history.

(56) References Cited

U.S. PATENT DOCUMENTS

| | | | | | |
|---|---|---|---|---|---|
| 4,543,755 | A | * | 10/1985 | Crandell | E06B 3/5427 52/204.62 |
| 4,650,702 | A | * | 3/1987 | Whitmyer | E06B 3/5427 428/31 |
| 4,799,344 | A | * | 1/1989 | Francis | E06B 3/5427 52/204.591 |
| 4,803,817 | A | * | 2/1989 | White | E06B 3/5427 52/235 |
| 5,199,236 | A | * | 4/1993 | Allen | E04C 2/54 52/204.591 |
| 5,369,924 | A | * | 12/1994 | Neudorf | E06B 3/5427 52/200 |
| 5,381,637 | A | * | 1/1995 | Farag | E06B 3/5427 52/204.593 |

(Continued)

OTHER PUBLICATIONS

"SuperWall Curtainwall—Window Wall Brochure", 2012, 7 pages.
Michno, Michel et al., "Cassette Wall System", 2012, pp. 106-113.

*Primary Examiner* — Beth A Stephan
(74) *Attorney, Agent, or Firm* — Dorsey & Whitney LLP

(57) ABSTRACT

The present disclosure describes cassette frame assemblies and methods of installing them onto curtainwall structures. Assemblies can include a mullion and a first cassette frame coupled to a front end of the mullion via an anchoring tab. The anchoring tab can be configured to move within the first cassette frame prior to installation. An assembly can also include a second cassette frame coupled to the front end of the mullion via a second anchoring tab. A first glass panel can be fixed to the first cassette frame and a second glass panel can be fixed to the second cassette frame. Anchoring tabs can be slidable and pivotable to facilitate safe and efficient installation onto a curtainwall structure.

23 Claims, 15 Drawing Sheets

(56) References Cited

U.S. PATENT DOCUMENTS 5,579,616 A * 12/1996 Farag ..... E04B 2/96 52/204.5
5,598,672 A * 2/1997 Nawa ..... E04B 2/962 52/204.69
5,603,789 A * 2/1997 Whitmyer ..... E04B 2/96 156/108
6,442,907 B1 * 9/2002 Doyon ..... E04F 13/081 52/204.5
6,598,361 B2 7/2003 Ting
6,715,248 B2 4/2004 Biebuyck
6,804,920 B2 * 10/2004 Hogan ..... E04B 2/96 52/204.5
7,334,371 B2 * 2/2008 Rinehart ..... B32B 17/10036 52/204.593
7,644,549 B2 1/2010 Speck
7,676,999 B2 * 3/2010 Arias ..... E06B 3/5427 292/175
7,779,584 B2 * 8/2010 Arias ..... E04B 2/965 52/204.591
7,832,160 B2 * 11/2010 Farag ..... B32B 17/10 52/204.57
8,782,969 B2 * 7/2014 Eickhof ..... E04H 13/006 52/134
8,991,121 B1 * 3/2015 Baker ..... E04B 2/90 52/235
9,752,319 B1 * 9/2017 LeVan ..... E04B 2/965
10,407,902 B2 * 9/2019 Doyon ..... E06B 3/5427
2004/0079038 A1 4/2004 Crooker
2007/0039258 A1 * 2/2007 Walker ..... E04B 2/96 52/235
2008/0066402 A1 3/2008 Walker et al.
2011/0296775 A1 * 12/2011 Dolby ..... E06B 3/5427 52/204.6
2015/0135615 A1 * 5/2015 Hogan ..... E04B 2/90 52/235
2017/0022708 A1 * 1/2017 Dolby ..... E04B 2/967
2019/0136523 A1 * 5/2019 Claeys ..... E04B 2/965

* cited by examiner

CASSETTE FRAME COMPONENTS AND METHODS OF INSTALLATION

TECHNICAL FIELD

Implementations relate to cassette frame components and methods of assembling such components. Particular implementations include cassette frame systems equipped with improved installation and anchoring components.

BACKGROUND

Buildings often include an exterior shell comprised of a window wall system or a curtainwall system. Such exterior shells typically provide little to no load-bearing structural support, but are frequently added for extra insulation, weather-proofing and aesthetic appeal. Window wall systems typically include glass panels installed between adjacent slabs of concrete flooring, while curtainwall systems are typically offset from the outer perimeter of the concrete flooring. As a result, curtainwall systems can include rigid glass panels of greater height than those implemented in window wall systems. Most curtainwall systems also avoid some of the primary disadvantages associated with window wall systems, such as leaking caused by the breakdown of caulking over time, and may thus be preferred over window walls.

Curtainwall systems can be essentially hung from the exterior surfaces of a building. Most curtainwall systems include rows of glass panels stacked on top of each other and connected to the flooring structure of the building via framing assemblies. Particular curtainwall systems may include or be coupled with cassette frames (sometimes called carrier frames), which are attached at one end to outwardly facing glass panels. At the other end, anchoring tabs couple the cassette frames with vertical and horizontal mullions comprising the curtainwall grid, which can be fastened directly to the concrete slabs of a building structure. Curtainwall configurations may vary significantly depending on the extent to which a particular system is assembled before or after arriving at the building site. Some curtainwall systems comprise modular, mostly pre-assembled components, while "stick" systems can include many sub-components that must be assembled onsite. Regardless of the specific configuration, at least some onsite assembly is necessary to secure the curtainwall, and particularly the cassette frames, to the building structure. Improved cassette frames that are easier and safer to install are needed.

SUMMARY

The present disclosure describes cassette frame assemblies and components, and improved methods of installation associated therewith. Disclosed methods may be implemented with enhanced ease in less time compared to pre-existing methods. Improved installation efficiency and safety can be attributed, at least in part, to the unique cassette frame components described herein, which may be installed via movable anchoring members. After installation, the exterior glass panels attached to the cassette frames may extend all the way to the perimeter of each curtainwall opening. In accordance with some examples, a curtainwall assembly can include a mullion and a first cassette frame coupled to a front end of the mullion via a first anchoring tab. The first anchoring tab can be configured to move within the first cassette frame prior to installation. The assembly may further comprise a second cassette frame coupled to the front end of the mullion via a second anchoring tab. A first glass panel can be fixed to the first cassette frame, and a second glass panel can be fixed to the second cassette frame.

In some examples, the second anchoring tab is configured to move within the second cassette frame prior to installation. In some embodiments, the first and second anchoring tabs are each configured to move by sliding along a longitudinal track defined by each of the first and second cassette frames. In some implementations, the first and second anchoring tabs are each configured to pivot about a pivot point defined by the longitudinal track defined by each of the first and second cassette frames. In some embodiments, the first and second glass panels are separated by a seal member positioned therebetween. In some examples, a first gasket seals a first interface between the first cassette frame and the mullion, and a second gasket seals a second interface between the second cassette frame and the mullion. In some implementations, the first and second glass panels each comprise two parallel panes of vision glass. In some examples, the assembly further includes a fastener member configured to secure the first and second anchoring tabs to the mullion. In some embodiments, the mullion comprises a vertical mullion.

In accordance with some embodiments, a method of installing a cassette frame assembly involves securing a lower cassette frame to a horizontal mullion via an anchoring member, wherein a lower glass panel is fixed to the lower cassette frame, and rolling an upper cassette frame onto the anchoring member, where an upper glass panel is fixed to the upper cassette frame and the upper cassette frame defines a coupling end configured to couple with the anchoring member.

In some examples, the anchoring member is configured to pivot and slide within a lateral track defined by the lower cassette frame. In some embodiments, the lateral track extends along a length of the lower cassette frame and defines an arcuate cross section. In some examples, the anchoring member is configured to provide dead-load support for the upper cassette frame and the upper glass panel during an installation. In some embodiments, the upper and lower glass panels are positioned within one column of a cassette frame structure after installation.

In accordance with some examples, a method of installing a cassette frame assembly may involve securing a first cassette frame to a horizontal mullion via a first anchoring tab, wherein the first cassette frame is fixed to a first glass panel, aligning a second cassette frame with the first cassette frame, where the second cassette frame is fixed to a second glass panel and coupled with a second anchoring tab, and securing the second cassette frame to the horizontal mullion.

In some embodiments, the method further involves repositioning at least one of the first or second anchoring tabs prior to securing the first and second cassette frames to the horizontal mullion. In some examples, repositioning comprises sliding at least one of the first or second anchoring tabs in a lateral direction along a track defined by at least one of the first or second cassette frames. In some implementations, repositioning comprises pivoting at least one of the first or second anchoring tabs within a track defined by at least one of the first or second cassette frames. In some examples, each of the first and second anchoring tabs is pivotable between an engaged position and a disengaged position, where in the engaged position, a free end defined by each anchoring tab is aligned with an aperture of the horizontal mullion configured to receive a fastener member.

In accordance with some embodiments, a method of installing a cassette frame assembly may involve securing a first cassette frame to a vertical mullion via a first anchoring tab, where the first cassette frame is fixed to a first glass panel, aligning a second cassette frame with the first cassette frame, wherein the second cassette frame is fixed to a second glass panel and coupled with a second anchoring tab, and securing the second cassette frame to the vertical mullion. In some examples, repositioning comprises sliding at least one of the first or second anchoring tabs in a vertical direction along a track defined by at least one of the first or second cassette frames and/or pivoting at least one of the first or second anchoring tabs within a track defined by at least one of the first or second cassette frames.

In accordance with some examples, a cassette frame assembly may include a cassette frame, a glass panel fixed to the cassette frame, and at least one movable anchoring member coupled with the cassette frame, where the anchoring member is configured to couple the cassette frame with a mullion. After an installation process, the glass panel can be positioned in front of, e.g., exterior to, the cassette frame at a perimeter structure of the cassette frame assembly, such that the glass panel extends to an edge of the perimeter structure. In some embodiments, the perimeter structure comprises a head structure, a jamb structure, or a sill structure, any one of which may further comprise sealant fill and in some examples, a plurality of backer rods. The mullion can be a vertical or horizontal mullion, which may constitute a portion of a curtainwall structure.

BRIEF DESCRIPTION OF THE DRAWINGS

The drawings illustrate generally, by way of example, but not by way of limitation, various embodiments discussed in this patent document. In the drawings.

The drawings are not necessarily to scale. Certain features and components may be shown exaggerated in scale or in schematic form, and some details may not be shown in the interest of clarity and conciseness.

DETAILED DESCRIPTION

Provided herein are improved cassette frame assemblies that include movable anchoring members and cassette frame components adaptable to various curtainwall systems. The disclosed assemblies enable improved installation methods and provide architecturally pleasing, "glass-to-edge" perimeter framing configured to position the exterior glass paneling to the outer edge of the curtainwall frame. Embodiments include improved cassette frames coupled with slidable and pivotable anchoring tabs configured to facilitate cassette installation. Particular examples can include cassette frames featuring at least one dead load, rock-on sill member and roll-in, slidable anchoring tabs. To install, assembled and glazed cassette frames disclosed herein can be lifted into place and set on anchoring receptors configured to carry the dead-load weight of the glass paneling and frame structure. The unique anchoring tabs can be preloaded on the jamb, head and/or sill of the cassette and slid into place prior to anchoring each cassette.

Improved installation methods are enabled by the cassette frame assembly components described herein. For example, cassette installation is aided by the implementation of dead-load cassette sill anchoring members, which as described herein, can comprise single anchoring members, e.g. tabs, configured to anchor adjacent lower and upper cassette frames in a single column of a curtainwall structure, thereby eliminating a need for double anchorage means at the horizontal seams. The slidable and pivotable anchor design allows the anchoring members to be slid into position after a cassette unit is coupled at its engineered location to a mullion, thereby providing additional flexibility compared to preexisting static anchors that are typically snapped or locked into position prior to setting a cassette unit at the designated opening in the curtainwall grid. For example, any interference with adjacent cassette frame anchors in preexisting systems required the entire cassette unit to be removed such that the anchoring members can be relocated. By contrast, once a cassette unit of the present disclosure is set on a dead-load anchoring member and pivoted and/or rocked into a vertical position at a curtainwall opening, a single head anchor configured to support the cassette frame can be adjusted as necessary before securing the cassette unit to the mullion of the curtainwall structure. As a result, a single person can complete the perimeter cassette unit anchorage, which reduces installation time and the amount of field labor required for installation, while also improving safety. The example method steps described below may be utilized, in any sequence, to install the systems and apparatuses described herein.

Figure 1:
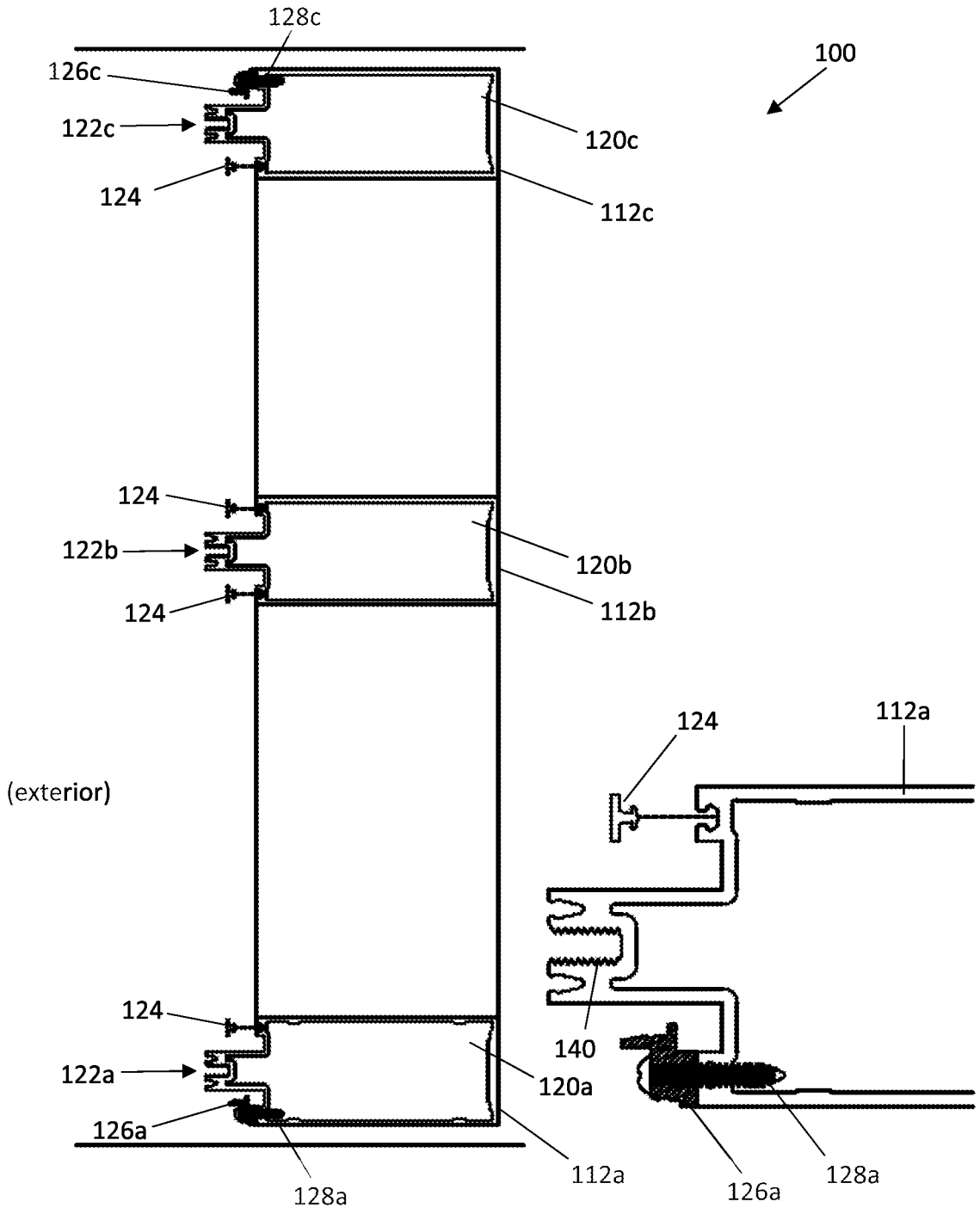
FIG. 1 is a sectional view of an initial step of a cassette installation method according to embodiments of the present disclosure.

FIG. 1 shows an initial step of an example cassette frame installation process. As shown, a curtainwall structure 100 comprised of, among other things, a plurality of horizontal mullions 112*a*, 112*b*, 112*c* to be installed prior to the cassette frames. The curtainwall structure 100 provides a grid-like frame that defines a plurality of openings, arranged in rows and columns, configured to eventually receive the cassette frames and glass panels coupled thereto. The portion of curtainwall structure 100 shown in the example of FIG. 1 defines a single column configured to receive two cassette frame units, each cassette frame unit secured to glass paneling. Each horizontal mullion 112*a*, 112*b*, 112*c* included in the curtainwall structure 100 can define an internal portion 120*a*, 120*b*, 120*c* which extends toward the internal, load-bearing structure of a building, and an exterior-facing, coupling portion 122*a*, 122*b*, 122*c*, each of which may define a threaded portion 140 configured to receive a fastener member, e.g., a screw. One or more recessed cassette gaskets 124 can be coupled with each horizontal mullion 112*a*, 112*b*, 112*c* after the initial curtainwall grid is installed at all perimeter locations. After installation of the cassette frames, the gaskets 124 seal the interface between each cassette frame and each mullion. The mullions 112*a*, 112*b*, 112*c* shown in FIG. 1 are tubular, but may not be tubular in other embodiments. In various embodiments, the cassette frames described herein can be used with non-shear block systems and shear block systems. Depending on the width of the overall curtainwall structure, multiple horizontal mullions may be aligned side-by-side (into the page), creating a laterally extending, internal tube defined by the outer perimeter of each mullion. In various embodiments, PVC thermal perimeter spacers 126*a*, 126*c* can also be installed prior to cutting, fabricating and installing the cassette frames. Each spacer 126*a*, 126*c* is secured to its respective mullion via a spacer fastener 128*a*, 128*c*.

Figure 2:
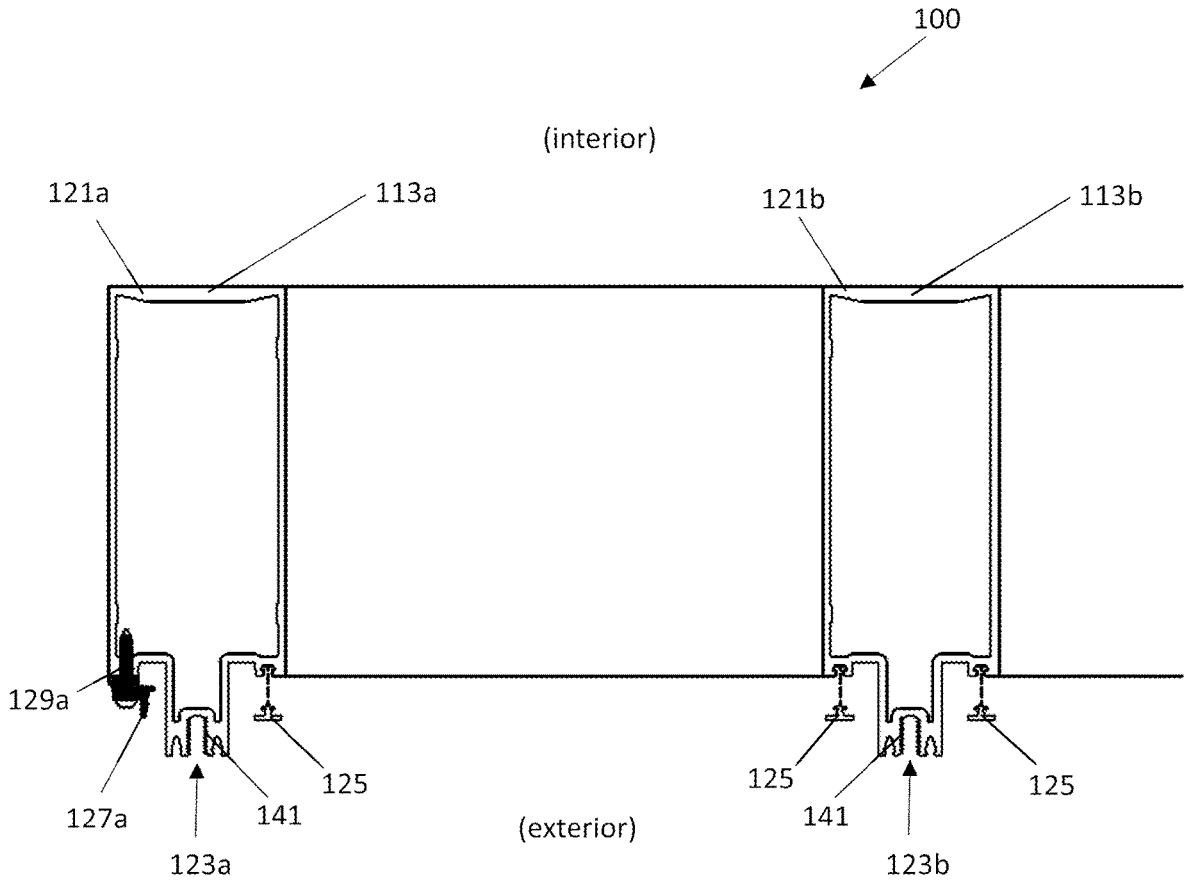
FIG. 2 is a sectional view of another initial step of a cassette installation method according to embodiments of the present disclosure.

FIG. 2 provides a different view of the initial step in an example cassette frame installation process, prior to the addition of the cassette frame units. As shown, the curtainwall structure 100 may also be comprised of a plurality of vertical mullions 113*a*, 113*b* that may be installed laterally between adjacent cassette frame units installed within the same row. Each vertical mullion 113*a*, 113*b* included in the curtainwall structure 100 can define an internal portion 121*a*, 121*b*, which extends toward the internal, load-bearing structure of the building, and an exterior-facing, coupling portion 123*a*, 123*b*, each of which may define a threaded portion 141 configured to receive a fastener member, e.g., a screw. One or more recessed cassette gaskets 125 can be coupled with each vertical mullion after the initial curtainwall grid is installed at all perimeter locations. A PVC thermal perimeter spacer 127*a* can also be installed prior to installation of the cassette frames. The spacer 127*a* shown in FIG. 2 is secured to vertical mullion 113*a* via fastener 129*a*. Depending on the height of the overall curtainwall structure, multiple vertical mullions may be stacked on top of one another, creating a vertically extending, internal tube defined by the outer perimeter of each mullion.

Figure 3:
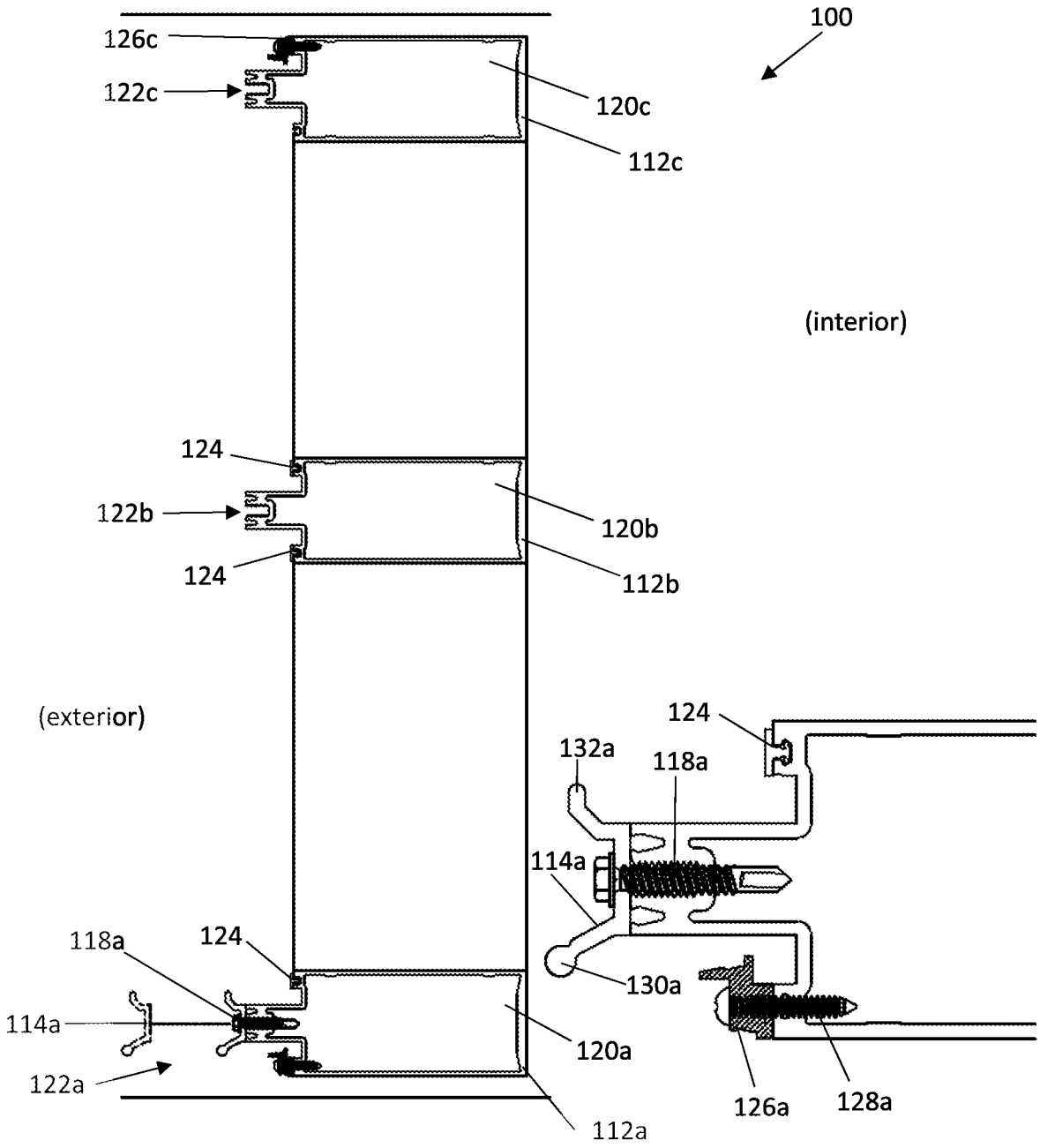
FIG. 3 is a sectional view of a subsequent step of a cassette installation method according to embodiments of the present disclosure.

FIG. 3 shows a subsequent step in an example installation process. At this point, the curtainwall structure 100 has been installed, and the cassette frame installation may begin. During the step shown, which may comprise the second step in an example ordered process, the lowest cassette sill anchoring member 114*a* can be installed by securing it to the coupling portion 122*a* of horizontal mullion 112*a* via a fastener 118*a*. The anchoring member 114*a* can define two end portions: a first end portion 130*a* and a second end portion 132*a*. In the embodiment shown, the first end portion 130*a* defines a rounded cross-sectional shape, and the second end portion 132*a* defines an approximately rectangular cross-sectional shape. The particular shape and dimensions of the anchoring member 114*a*, including the first and second end portions 130*a*, 132*a*, may vary in different examples. Once secured, the anchoring member 114*a* is positioned to provide dead-load support for the first cassette frame unit coupled to the curtainwall structure 100.

Figure 4:
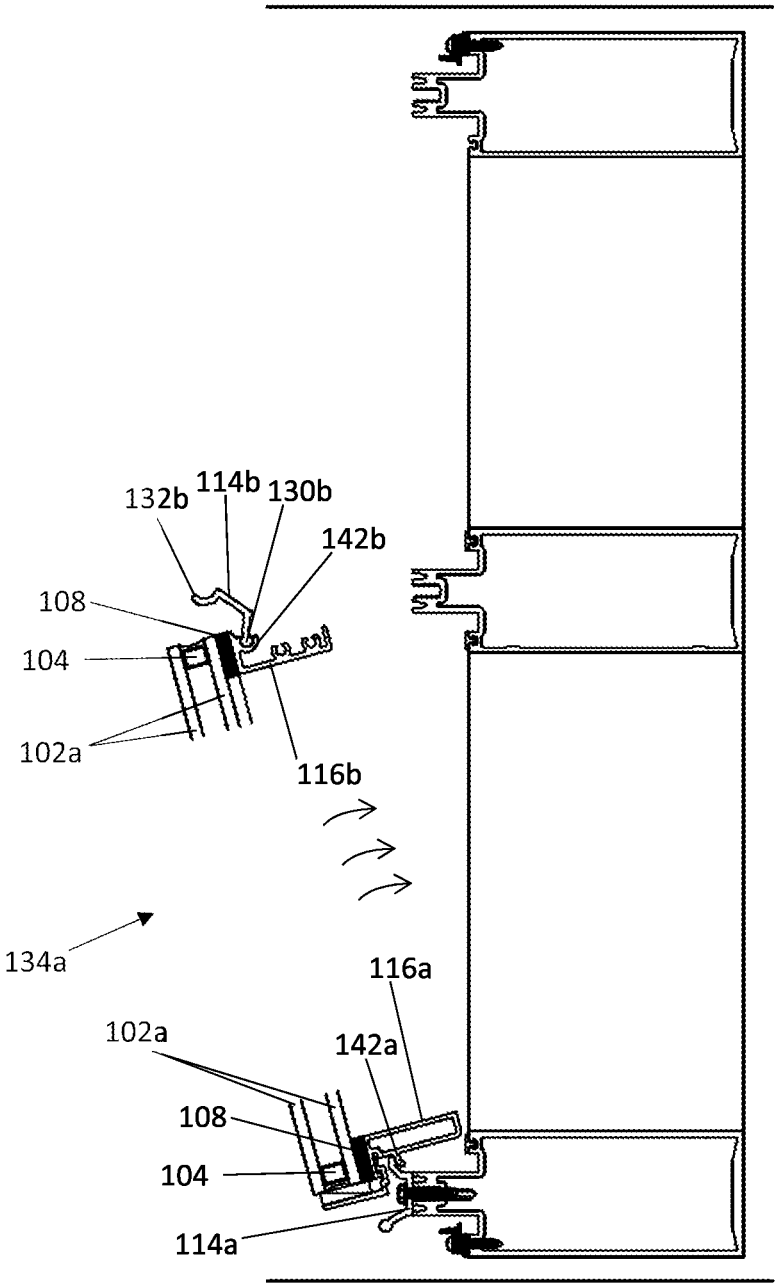
FIG. 4 is a sectional view of a subsequent step of a cassette installation method according to embodiments of the present disclosure.

FIG. 4 shows a subsequent, e.g., third, step in an example cassette frame installation process. As shown, a first cassette frame unit 134*a*, which includes a pair of parallel glass panels 102*a* attached at opposite ends to cassette frames 116*a*, 116*b*, can be rolled or rocked over the anchoring member 114*a*, in the direction of the arrows, toward a vertical orientation. As the cassette frame unit 134*a* is being rocked in the direction shown, anchoring member 114*a* supports the weight of the cassette frame unit 134*a* from below, thereby facilitating installation and reducing the number of installers required to position the cassette frame unit at the curtainwall opening. The glass panels 102*a* are separated by spacer units 104, and affixed to the cassette frames 116*a*, 116*b* via a layer of structural silicone and/or VHB™ tape (sold by 3M™) 108, for example. The first cassette frame 116*a* can be coupled at a first end 142*a* to the second end portion 132*a* of the anchoring member 114*a*. A first end 142*b* defined by the second (upper) cassette frame 116*b* can be coupled to a first end 130*b* defined by a movable anchoring tab 114*b*, which provides a head anchor for the cassette frame unit 134*a*. The first end 142*b* of cassette frame 116*b* can define an arcuate, clip-like structure that is complementary to the rounded shape of the first end 130*b* of the anchoring tab 114*b*. Each cassette frame 116*a*, 116*b* can be fully assembled and glazed at this point in the installation process.

Figure 5:
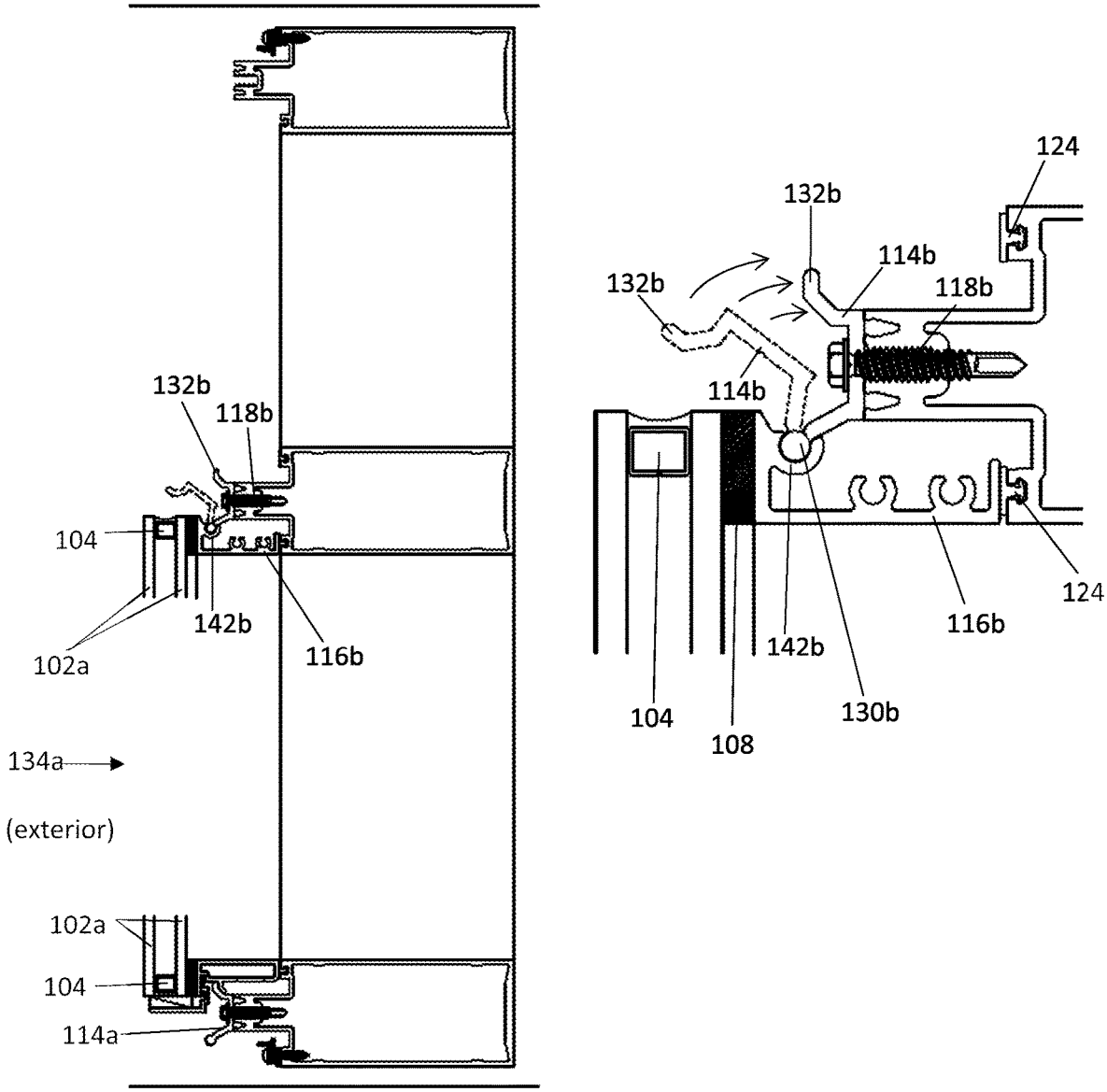
FIG. 5 is a sectional view of a subsequent step of a cassette installation method according to embodiments of the present disclosure.

FIG. 5 shows a subsequent, e.g., fourth, step in an example installation process, illustrating the first cassette frame unit 134*a* positioned at the curtainwall structure 100. The cassette frame unit 134*a* remains resting on the dead-load support provided by the lowest cassette sill anchoring member 114*a*. For this reason, anchoring member 114*a* may be referred to as a "dead-load anchor" in various examples. The anchoring tab 114*b* coupled to the upper cassette frame 116*b* can be slid into an engineered location while the cassette frame unit 134*a* rests on the lower anchoring member 114*a*, thereby facilitating installation by enabling an installer to adjust the anchoring tab position without simultaneously supporting the weight of the cassette frame unit, which would require additional installers. As shown in this particular embodiment, the first end 142*b* of the cassette frame 116*b* can be configured to mate with the first end 130*b* of the anchoring tab 114*b* via a mechanism resembling a ball-and-socket joint, thereby allowing the anchoring tab 114*b* to pivot about the connection point between the two components. For example, the anchoring tab 114*b* can be pivoted in the direction of the arrows from a first, disengaged position (represented by dashed lines), to a second, engaged position (represented by solid lines). In the disengaged position, the anchoring tab 114*b* can be slid horizontally (into the page) along an elongate longitudinal track defined by the first end 142*b* of the cassette frame 116*b*. The track can extend along the entire width of the cassette frame 116*b*, or a portion thereof, such that the anchoring tab 114*b* can be slid across the cassette frame 116*b*, and thus the mullion 112*b*, as necessary to position the anchoring tab 114*b* at a particular location relative to other anchoring members, e.g., anchoring member 114*a*, such that in some examples, the anchoring members can be staggered. When the anchoring tab 114*b* is in the proper position along the width of the cassette frame 116*b* and the mullion 112*b*, it can be rotated into the engaged position, such that the free, second end 132*b* can be secured to the mullion 112*b* via a fastener 118*b*. Anchoring tabs may be conventionally staggered from unit to unit at the head, sill and jamb structures. As further described below, each of the adjustable anchoring members provided herein can be slid to the position necessary to achieve proper staggering after each glass unit is mounted at its correct location.

Figure 6:
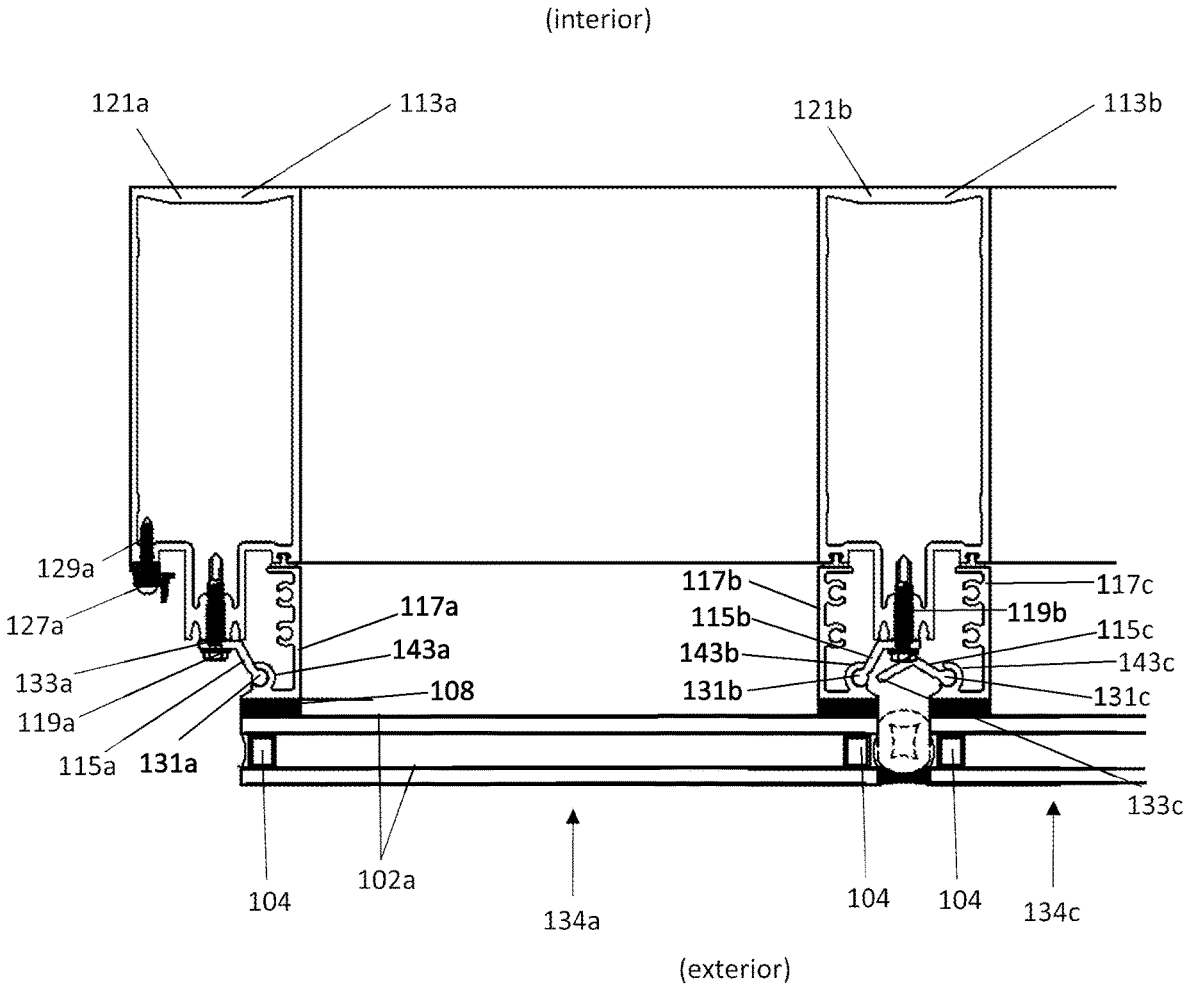
FIG. 6 is a sectional view of a subsequent step of a cassette installation method according to embodiments of the present disclosure.

FIG. 6 shows a subsequent, e.g., fifth, step in an example installation process, showing the cassette frame unit 134*a* being installed between two adjacent vertical mullions 113*a*, 113*b*. As shown in the illustrated sectional view, the cassette frame unit 134*a* can also include, at opposite lateral ends, cassette frames 117*a* and 117*b*. The cassette frames 117*a*, 117*b* can be coupled with anchoring members, which may be referred to as jamb anchoring members or tabs. In the particular embodiment shown, cassette frame 117*a* defines a first end 143*a* that is pivotably coupled with a first end portion 131*a* defined by an anchoring tab 115*a*. The second end 133*a* of the anchoring member 115*a* is secured to the mullion 113*a* via a fastener 119*a*. The first end 143*a* of the cassette frame 117*a* can define an arcuate, clip-like structure that is complementary to the rounded shape of the first end 131*a* of the anchoring tab 115*a*.

At the opposite end of the cassette frame unit 134*a*, cassette frame 117*b* couples the unit to vertical mullion 113*b*. Like cassette frame 117*a*, cassette frame 117*b* can define a first end 143*b* that is coupled with a first end portion 131*b* defined by an anchoring tab 115*b*. The first end 143*b* of the cassette frame 117*b* can define an arcuate, clip-like structure that is complementary to the rounded shape of the first end 131*b* of the of the anchoring tab 115*b*.

As further shown in FIG. 6, one end of a second cassette frame unit 134*c* can be coupled to the curtainwall structure at vertical mullion 113*b*. The second cassette frame unit 134*c* includes, at the end shown, a cassette frame 117*c* that defines an arcuate first end 143*c* configured to couple with a first end 131*c* of an anchoring tab 115*c*. Like the anchoring tab 114*b* shown in FIG. 5, anchoring tabs 115*a*, 115*b*, 115*c* can be slidable and pivotable with respect to the vertically extending, elongate tracks defined by the cassette frames to which the tabs are respectively coupled, thus allowing each tab to be slid vertically to a desired location while the cassette frame unit 134*a* rests on its lower anchoring member, e.g., anchoring member 114*a* (FIG. 3). Each of the anchoring tabs 115*a*, 115*b*, 115*c* can be configured to mate with its respective cassette frame via a mechanism resembling a ball-and-socket joint, as described above, such that the tabs can pivot about the connection point with the cassette frames. This pivoting action is illustrated with respect to anchoring tabs 115*b* and 115*c*. Anchoring tab 115*c* is shown in a first, disengaged position, in which the second end 133*c* is unsecured. To couple the second end 133*c* to the mullion 113*b*, it can be pivoted towards the mullion and secured thereto via a fastener 119*b*. Anchoring tab 115*b* is shown in this second, engaged position. Prior to securing the second end 133*c* to the mullion 113*b*, it can be slid vertically (into the page) along the elongate vertical track defined by the first end 143*c* of the cassette frame 117*c*. The track can extend along the entire height of the cassette frame 117*c*, or a portion thereof, such that the anchoring tab 115*c* can be slid up and down the cassette frame 117*c*, and thus the mullion 113*b*, as necessary to position the anchoring tab 115*c* at a particular location relative to the other anchoring members, e.g., anchoring members 115*a/b*, such that in some examples, the anchoring members can be staggered. For example, to accommodate both anchoring members 115*b* and 115*c* at the same vertical mullion 113*b*, the anchoring members may be vertically offset from each other. By being pivotable and slidable within the track defined by the first end 143*b*, 143*c* of each cassette frame 117*b*, 117*c*, each anchoring tab 115*b*, 115*c* can reduce the time needed to couple the cassette frame units 134*a*, 134*c* with mullions 113*a*, 113*b* and make any adjustments during the process. Preexisting anchoring tabs are typically snapped into place and are not slidable or pivotable, thus hindering any tab position adjustments that may be needed during and after installation. As a result, arranging each glass unit in preexisting curtainwall structures, which often include many glass units arranged in rows and columns, may necessitate extensive coordination to ensure that each tab is positioned properly.

Figure 7:
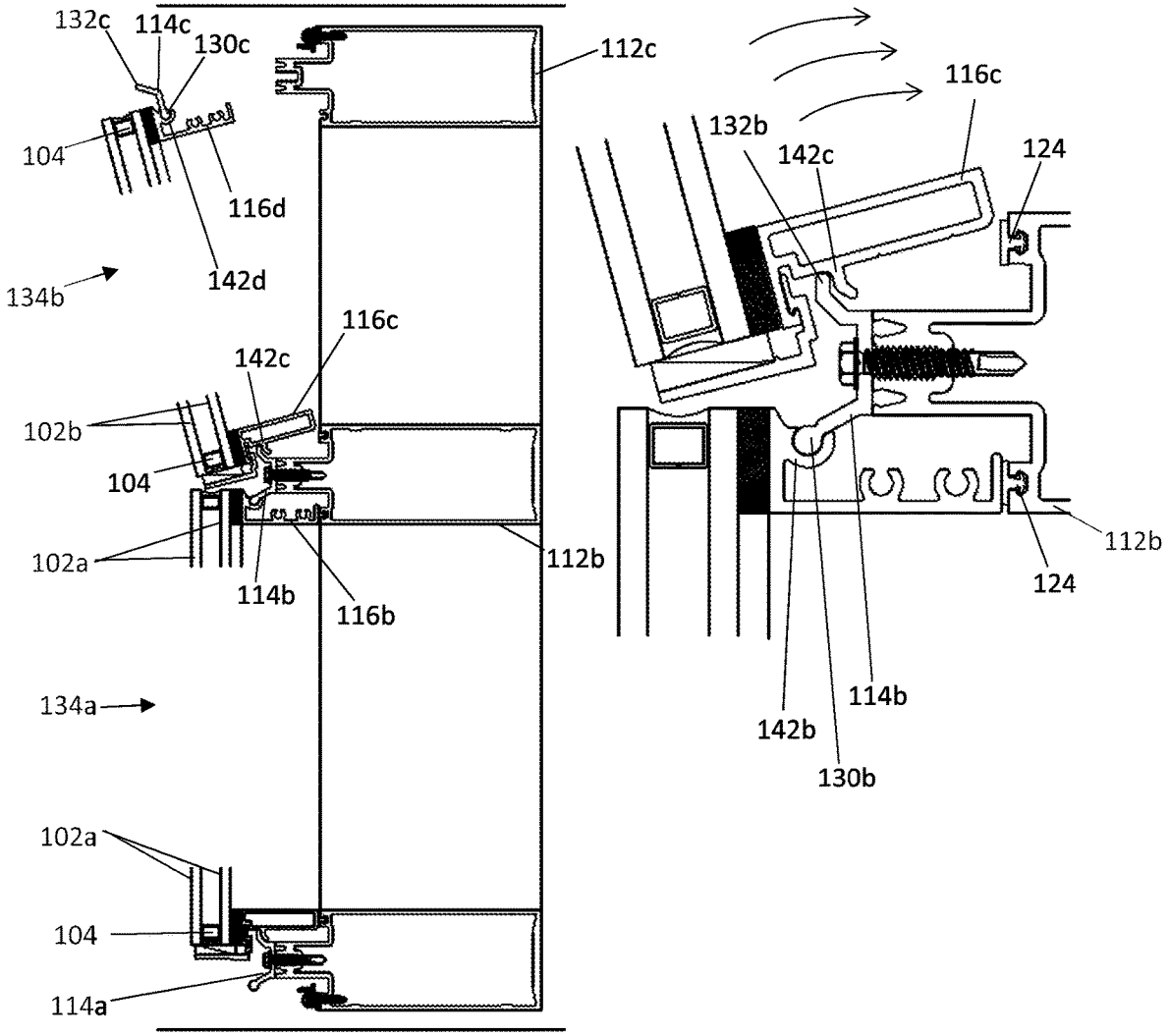
FIG. 7 is a sectional view of a subsequent step of a cassette installation method according to embodiments of the present disclosure.

FIG. 7 shows a subsequent, e.g., sixth, step in an example installation process. In this step, an additional cassette frame unit 134*b* can be coupled with the curtainwall structure. The cassette frame unit 134*b* is installed above the first cassette frame unit 134*a*, continuing up a column defined by the curtainwall opening. The process for installing the second cassette frame unit 134*b* is similar to the process used to install the first cassette frame unit 134*a*. The anchoring tab 114*b* coupled with already-installed cassette frame 116*b* provides dead-load support for the second cassette frame unit 134*b* while the unit is adjusted and secured to horizontal mullions 112*b* and 112*c*. As such, anchoring tab 114*b* provides head support for the lower cassette frame unit 134*a* and dead-load support for the upper cassette frame unit 134*b*. The lower cassette frame 116*c* defines a first end 142*c*, which can be rolled or rocked, in the direction of the arrows, onto the second end 132*b* of anchoring tab 114*b*. The first end 142*c* of the cassette frame 116*c* can define a more rectangular, clip-like structure that is complementary to the upper portion 132*b* of the anchoring tab 114*b*. At the opposite, upper end of the cassette frame unit 134*b*, cassette frame 116*d* can define a first end portion 142*d*, which can be configured to couple with a first end 130*c* of anchoring tab 114*c* via the ball-and-socket mechanism. Anchoring tab 114*c* also defines a second end 132*c*, which is shown in a disengaged position Like the first end 142*b* of cassette frame 116*b*, the first end 142*d* defined by cassette frame 116*d* can define an elongate longitudinal track that may extend along the entire width of the cassette frame 116*d*, or a portion thereof, such that the anchoring tab 114*c* can be slid across the cassette frame 116*d*, and thus the mullion 112*c*, as necessary to position the anchoring tab 114*c* at a particular location relative to the other anchoring members, e.g., anchoring members 114*a* and/or 114*b*, such that the anchoring members can be staggered in various embodiments. Rocking the upper cassette frame unit 134*b* into place provides easier, safer and/or faster installation means than preexisting cassette frame installation systems, which typically require parallel installation of each cassette frame assembly.

Figure 8:
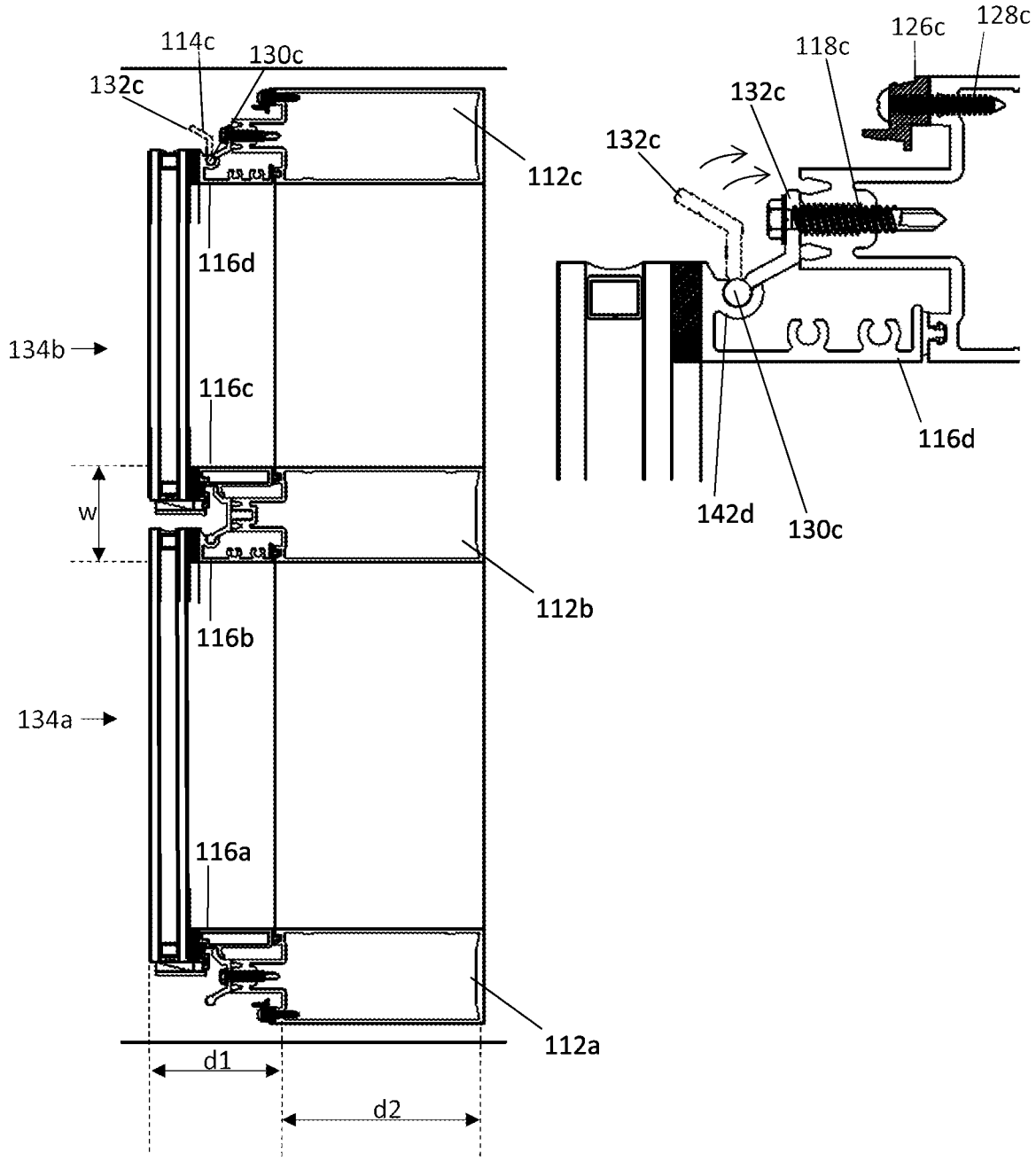
FIG. 8 is a sectional view of a subsequent step of a cassette installation method according to embodiments of the present disclosure.

FIG. 8 shows a subsequent, e.g., seventh, step in an example installation process, during which anchoring tab 114*c* can be pivoted into an engaged position and secured to the top mullion 112*c* shown via a fastener 118*c*. Anchoring tab 114*c*, after arriving at its pre-specified lateral location along the track defined by the cassette frame 116*d* to which it is coupled, can be pivoted in the direction of the arrows from a first, disengaged position (represented by dashed lines), to a second, engaged position (represented by solid lines), where the second end 132*c* can be secured to mullion 112*c* via fastener member 118*c*. Because cassette frame unit 134*b* may be installed at the perimeter head of the curtainwall opening, such that no additional units are installed above unit 134*b*, anchoring tab 114*c* may not provide dead-load weight support. As such, the anchoring member (or clip) 114*c* lacks an upper portion configured to support an additional cassette frame unit that would otherwise extend above the position where the fastener 118*c* is inserted.

The specific dimensions of the curtainwall assembly 100, with the installed cassette frames and glass panels, may vary. In the example shown, the interior depth d1 of each cassette frame 116*a-d* from the outer surface of each pair of glass panels is about 3.25 inches. In embodiments, the depth d1 may range from about 1 to about 8 inches, about 1.5 to about 6 inches, about 2 to about 5 inches, about 2.5 to about 4 inches, or about 3 to about 3.5 inches. The depth d2 of the each mullion 112*a-c* may also vary, ranging from about 5.5 inches in the example shown to between about 2 and about 8 inches, about 3 and about 7 inches, about 4 and about 6 inches, or about 5.25 and about 5.75 inches in additional examples. The sight line width w, which may define the width of the cassette frames and mullion, is about 2.5 inches in the example shown. In embodiments, the sight line width w may range from about 1 to about 6 inches, about 1.5 to about 4 inches, or about 2 to about 3 inches. The thickness of each pair of glass panels 102*a*, 102*b* may also vary. In the example shown, each pair has a total thickness of about 1 inch, but in additional examples the thickness can range from about 0.25 to about 1.125 inches. In an embodiment, each individual glass panel can be about 0.25 inches thick, with a space between each panel spanning about 0.5 inches. It is understood that other glass thicknesses may also be implemented in accordance with embodiments described herein to accommodate various curtainwall systems. The dimensions of the structure shown in FIG. 8 may be approximately equal to or identical to the analogous dimensions of each assembly illustrated herein.

In some examples, the panels 102*a*, 102*b* can be comprised entirely of vision glass, while in some embodiments, combinations of vision and spandrel glass may be implemented. In some examples, other finishing materials may be used, such as sheet metal. Various embodiments may additionally or alternatively include monolithic panels, insulated panels, or laminated panels. The panels can be finished with various materials, including but not limited to stainless steel, granite, limestone, aluminum, or composite materials. The structural components shown in FIG. 8, such as the cassette frames 116*a-d*, horizontal mullions 112*a*-112*c* and anchoring members 114*a-c*, can be comprised of aluminum. In some examples, one or more structural components may be comprised of steel or a composition material.

The number of anchoring members, e.g., tabs and/or clips, employed to install each cassette frame unit may vary. In some examples, each cassette frame unit may be coupled with one, two, three, four, five or more anchoring members, e.g., 8, 10, or up to 15, each anchoring member configured to slide laterally or vertically (depending on the orientation of the mullions to which it is coupled). Repositioning the anchoring members can be performed at any point prior to fastening them to a mullion.

Figure 9:
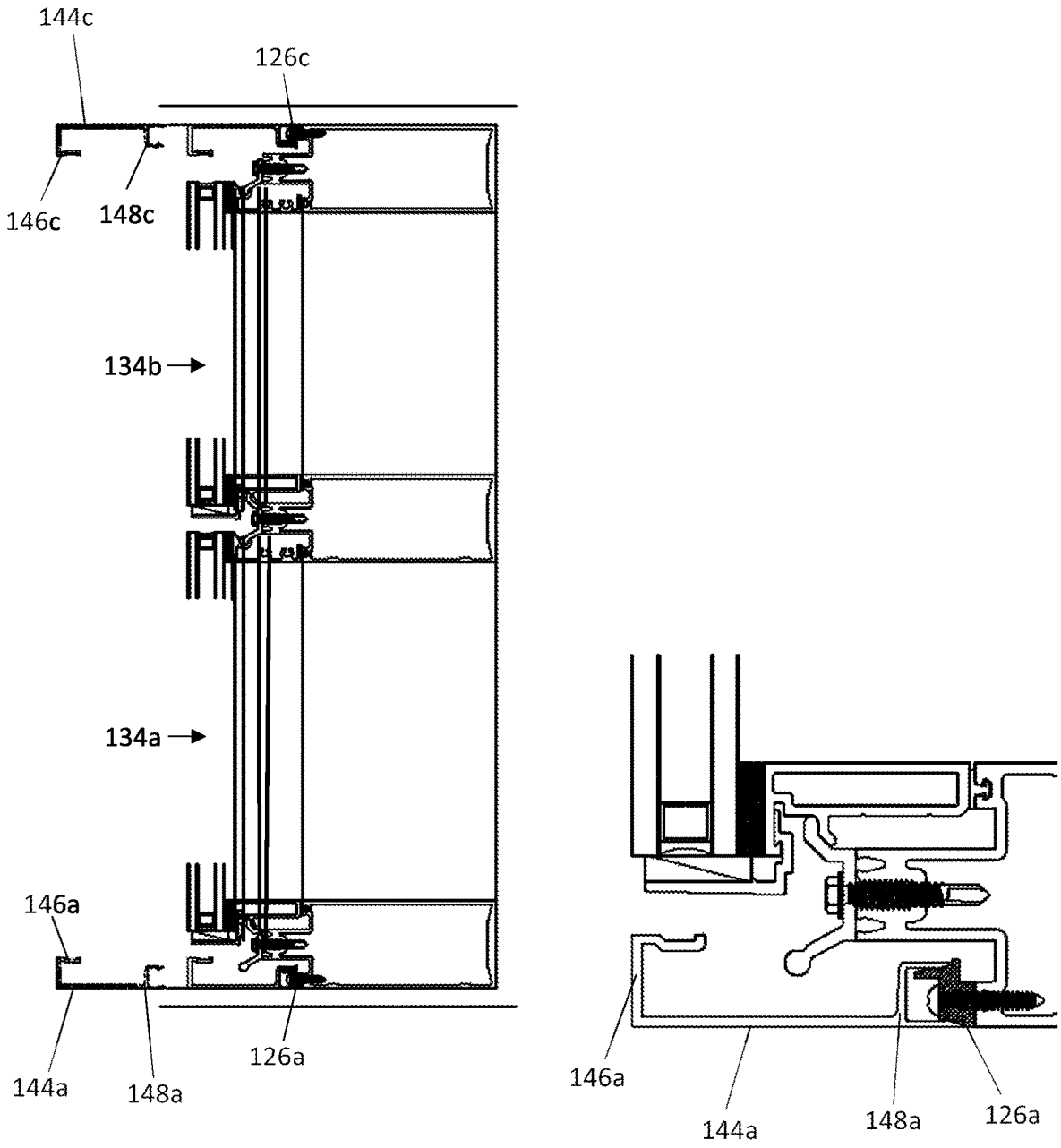
FIG. 9 is a sectional view of an subsequent step of a cassette installation method according to embodiments of the present disclosure.

FIG. 9 shows a subsequent, e.g., eighth, step in an example installation process. As shown, after the cassette frame units are installed and anchored to the horizontal mullions 112*a*-112*c*, perimeter closure members 144*a*, 144*c* can be installed over the PVC thermal separators 126*a*, 126*c*, respectively. In some embodiments, the closure members 144*a*, 144*c*, which may be comprised of extruded aluminum, can be snap-fitted over the separators 126*a*, 126*c*, respectively, for a clean-edge finish that eliminates the need to pre-cut and pre-attach the perimeter closure. Each of the closure members 126*a*, 126*c* defines an outer end 146*a*, 146*c* and an inner end 148*a*, 148*c*. The inner ends 148*a*, 148*c* define the coupling portion of the closure members that may snap onto the thermal spacers.

Figure 10:
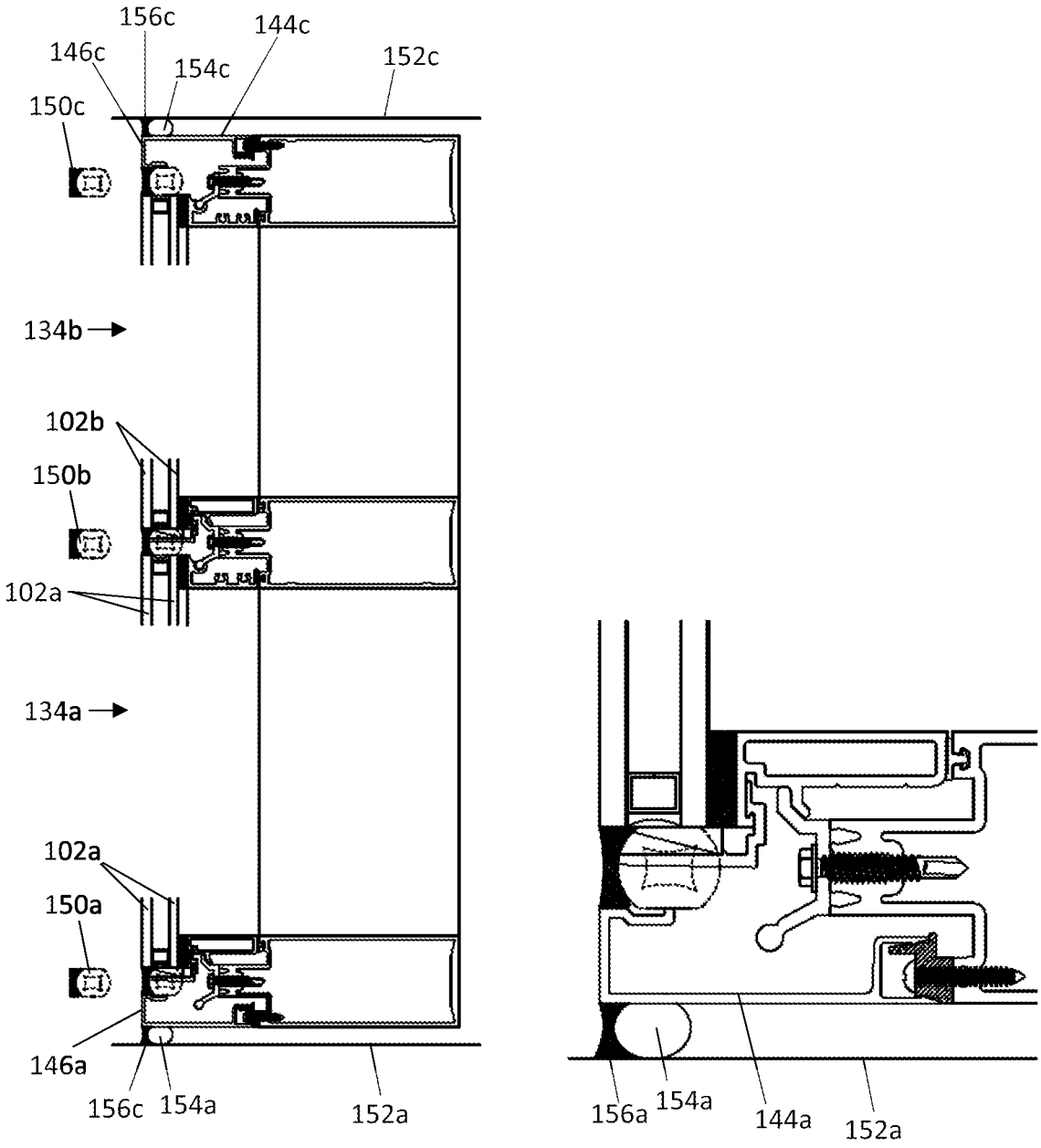
FIG. 10 is a sectional view of a subsequent step of a cassette installation method according to embodiments of the present disclosure.

FIG. 10 shows a subsequent, e.g., ninth, step in an example installation process. After the cassette frames and perimeter closure members have been installed, seal members can be inserted between each adjacent cassette frame unit 134*a*, 134*b*, and between each unit and the perimeter curtainwall structures. Primary seal members 150*a*, 150*c* are installed near the sill and head, respectively, sandwiched between the perimeter edge of the glass panels and the outer ends 146*a*, 146*c* of the perimeter closure members. A third primary seal member 150*b* can be inserted between the glass panels 102*a* of the first cassette frame unit 134*a* and the glass panels 102*b* of the second cassette frame unit 134*b*. Between the sill structure 152*a* and the lower perimeter closure member 144*a*, at least one backer rod 154*a* and sealant fill 156*a* are included. Similarly, between the head structure 152*c* and the upper perimeter closure member 144*c*, at least one backer rod 154*c* and sealant fill 156*c* can be installed.

Figure 11:
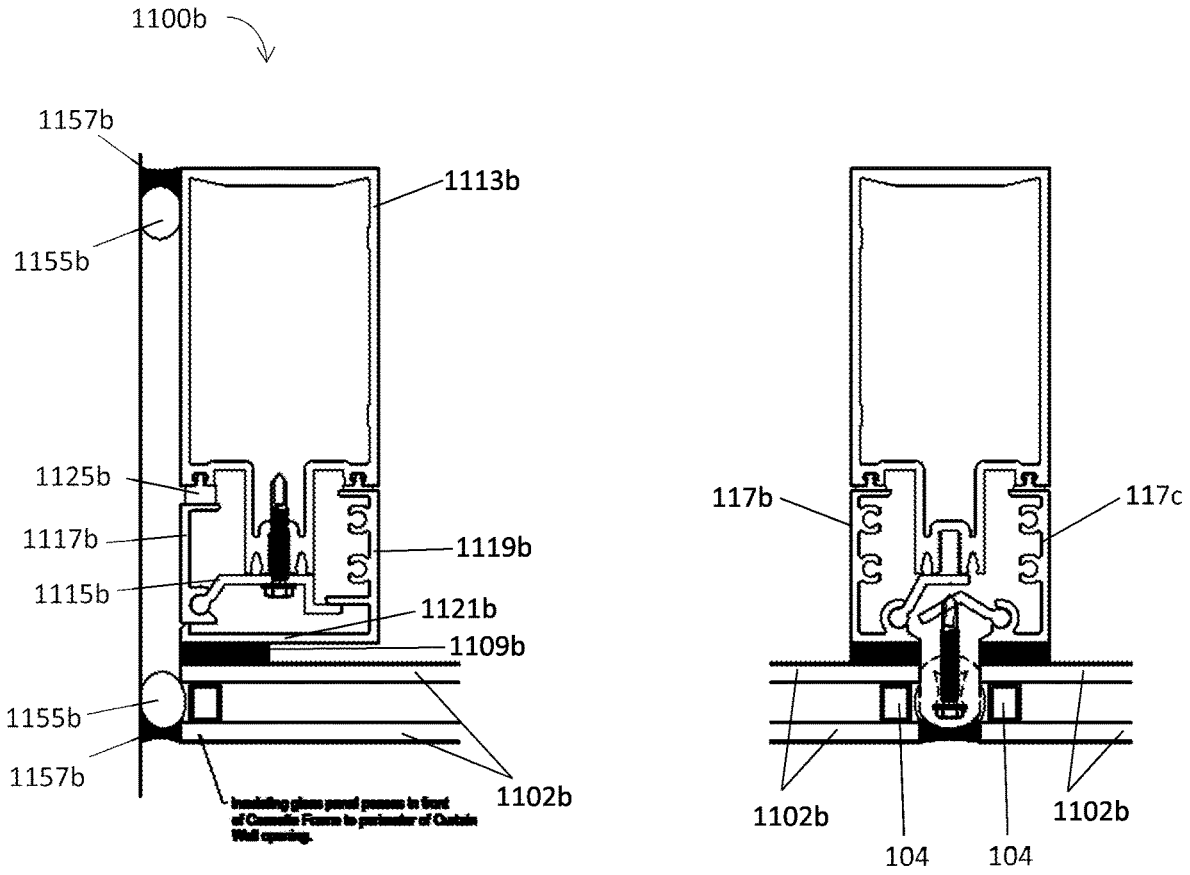
FIG. 11 is a sectional view of jamb glass-to-edge cassette framing assemblies according to embodiments of the present disclosure.

Cassette frame assemblies configured according to embodiments herein can include "glass-to-edge" exterior paneling, i.e., glass panels that completely cover perimeter framing at curtainwall openings, which can improve the sealing and aesthetic properties of the overall curtainwall structure. FIG. 11 show an example of such glass-to-edge features according to embodiments herein. As shown in the jamb glass-to-edge assemblies of FIG. 11, the unique design of the cassette frames allows the outer glass paneling of the cassette frame assembly to extend all the way to the perimeter of the curtain wall frame opening, passing in front of the cassette frames. This glass-to-edge feature is evident along the lateral perimeter (jamb) assemblies, such as jamb assembly 1100*b*, where no perimeter metal closures may be necessary. Instead, the outer glass paneling 1102*b* extends all the way to and aligns with the perimeter frame structure, enhancing the architectural and aesthetic appeal of the design. As shown, the jamb assembly 1100*b* includes an outer cassette frame 1117*b* and an inner cassette frame 1119*b*. The outer cassette frame 1117*b* can be pre-loaded, in some examples, onto a vertical mullion 1113*b* and a jamb structure comprised of at least one backer rod 1155*b* and sealant fill 1157*b*. A cassette gasket 1125*b* is included between an inner surface of the outer cassette frame 1117*b* and an outer surface of the mullion 1113*b*. As shown, the gasket 1125*b* may not be recessed. An anchoring member 1115*b* can be pivotably and slidably coupled with the outer cassette frame 1117*b*. The inner cassette frame 1119*b* can define an elongate portion 1121*b*, which is attached to the inner glass panel 1102*b* via a layer of structural silicone and/or VHB™ tape (sold by 3M™) 1109*b*. After installation, as shown, the glass panels 1102*b* of the cassette frame jamb assembly pass in front, i.e., exterior to, the cassette frames 1117*b*, 1119*b* coupled thereto, such that an outer edge of the glass panels directly contact, and align with, a portion of sealant 1157*b* and a backer rod 1155*b*, with no gap therebetween.

Figure 12:
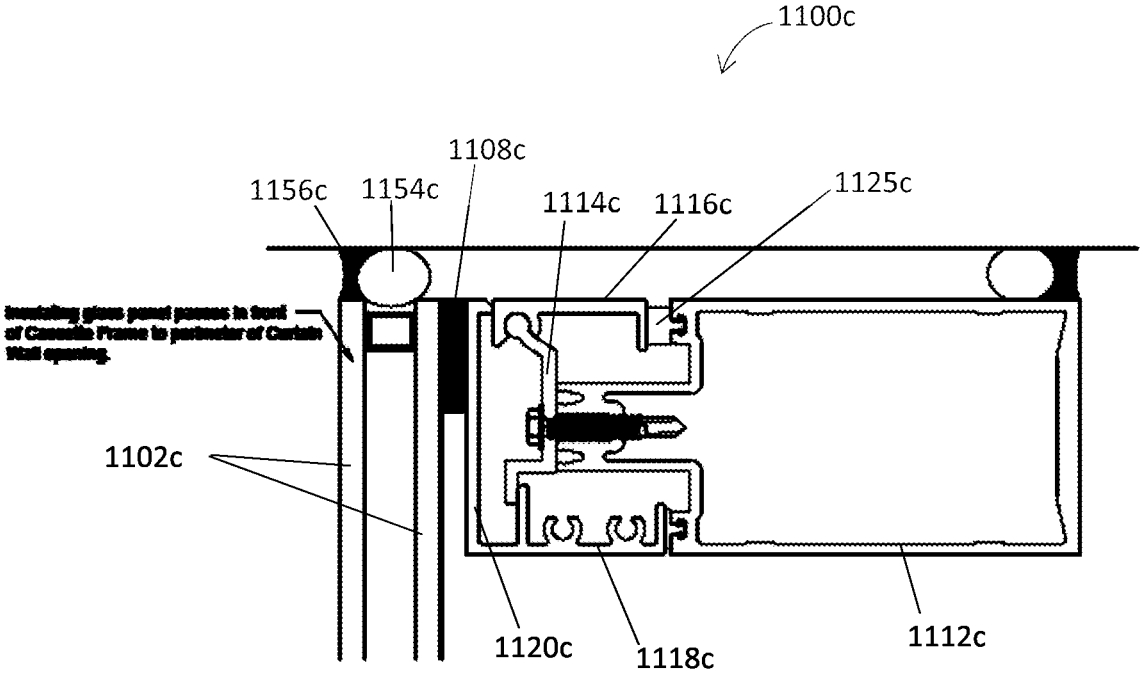
FIG. 12 is a sectional view of head glass-to-edge assemblies according to embodiments of the present disclosure.
Figure 12:
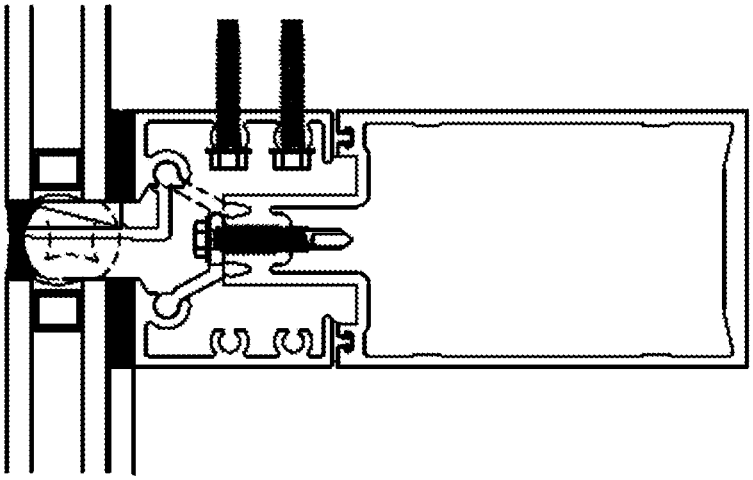

Analogously, FIG. 12 provides a sectional view of a head glass-to-edge assembly 1100*c*, which includes an upper cassette frame 1116*c* and a lower cassette frame 1118*c*. The upper cassette frame 1116*c* can be pre-loaded, in some examples, onto a horizontal mullion 1112*c* and a head structure comprised of at least one backer rod 1154*c* and sealant fill 1156*c*. A gasket 1125*c* is included between an inner surface of the upper cassette frame 1116*c* and an outer surface of the mullion 1112*c*. As shown, the gasket 1125*c* may not be recessed. An anchoring member 1114*c* can be pivotably and slidably coupled with the upper cassette frame 1116*c*. The lower cassette frame 1118*c* can define an elongate portion 1120*c* which is attached to the inner glass panel 1102*c* via a layer of structural silicone and/or VHB™ tape (sold by 3M™) 1108*c*. After installation, as shown, the glass panels 1102*c* of the cassette frame head assembly pass in front, i.e., exterior to, the cassette frames 1116*c*, 1118*c* coupled thereto, such that the upper edge of the glass panels directly contact, and align with, a portion of sealant 1156*c* and a backer rod 1154*c*, with no gap therebetween.

Figure 13:
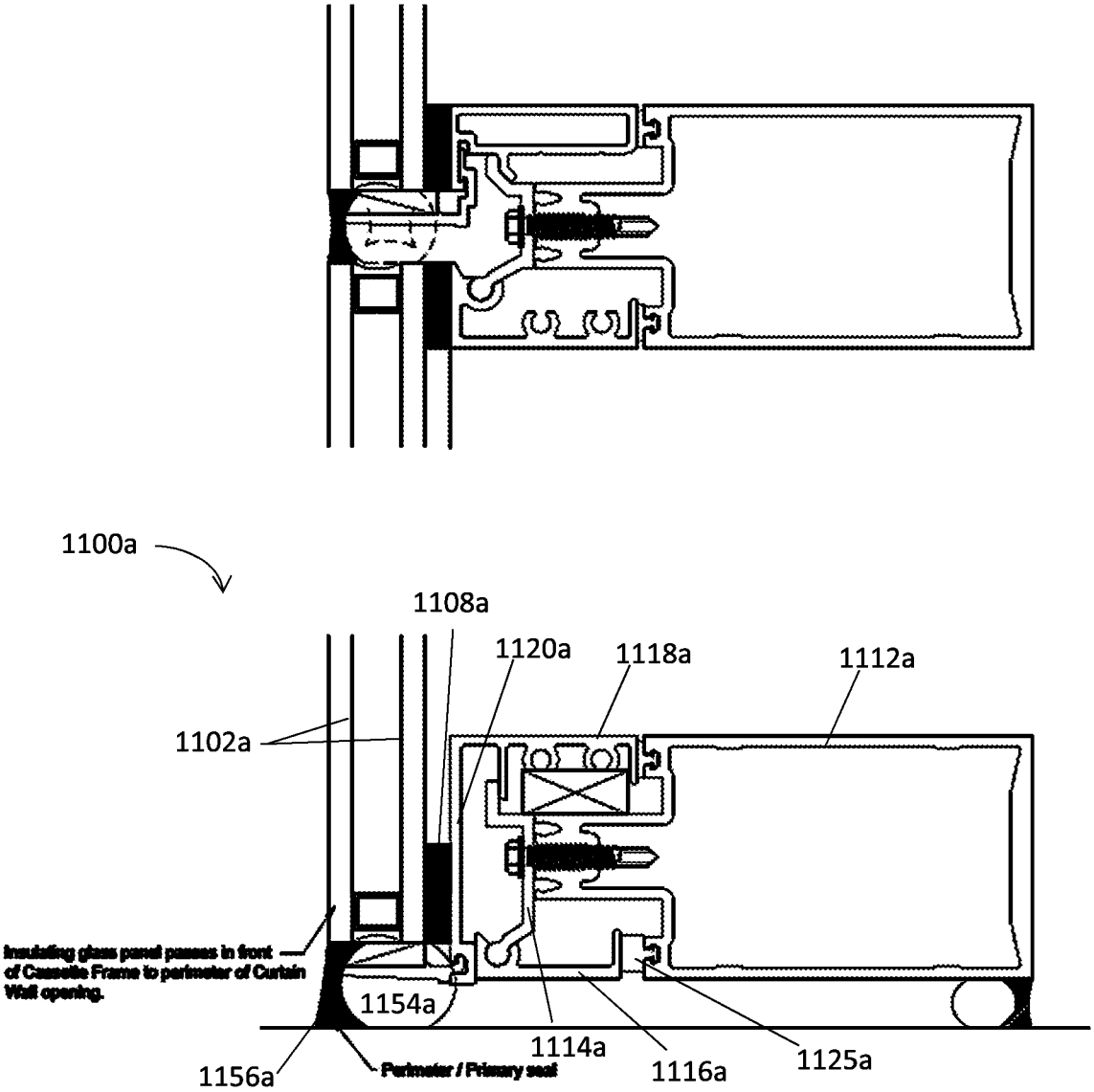
FIG. 13 is a sectional view of sill glass-to-edge assemblies according to embodiments of the present disclosure.

FIG. 13 provides a sectional view of a sill glass-to-edge assembly 1100*a*, which includes a lower cassette frame 1116*a* and an upper cassette frame 1118*a*. The lower cassette frame 1116*a* can be pre-loaded, in some examples, onto a horizontal mullion 1112*a* and a sill structure comprised of at least one backer rod 1154*a* and sealant fill 1156*a*. A cassette gasket 1125*a* is included between an inner surface of the lower cassette frame 1116*a* and an outer surface of the mullion 1112*a*. As shown, the gasket 1125*a* may not be recessed. An anchoring member 1114*a* can be pivotably and slidably coupled with the lower cassette frame 1116*a*, where it can provide dead-load weight support for the upper cassette frame 1118*a* and glass panels 1102*a*. The upper cassette frame 1118*a* can define an elongate portion 1120*a* which is attached to the inner glass panel 1102*a* via a layer of structural silicone and/or VHB™ tape (sold by 3M™) 1108*a*. After installation, as shown, the glass panels 1102*a* of the cassette frame sill assembly pass in front, i.e., exterior to, the cassette frames 1116*a*, 1118*a* coupled thereto, such that a lower edge of the glass panels directly contact, and align with, a portion of the sealant 1156*a* and a backer rod 1154*a*, with no gap therebetween.

Figure 14:
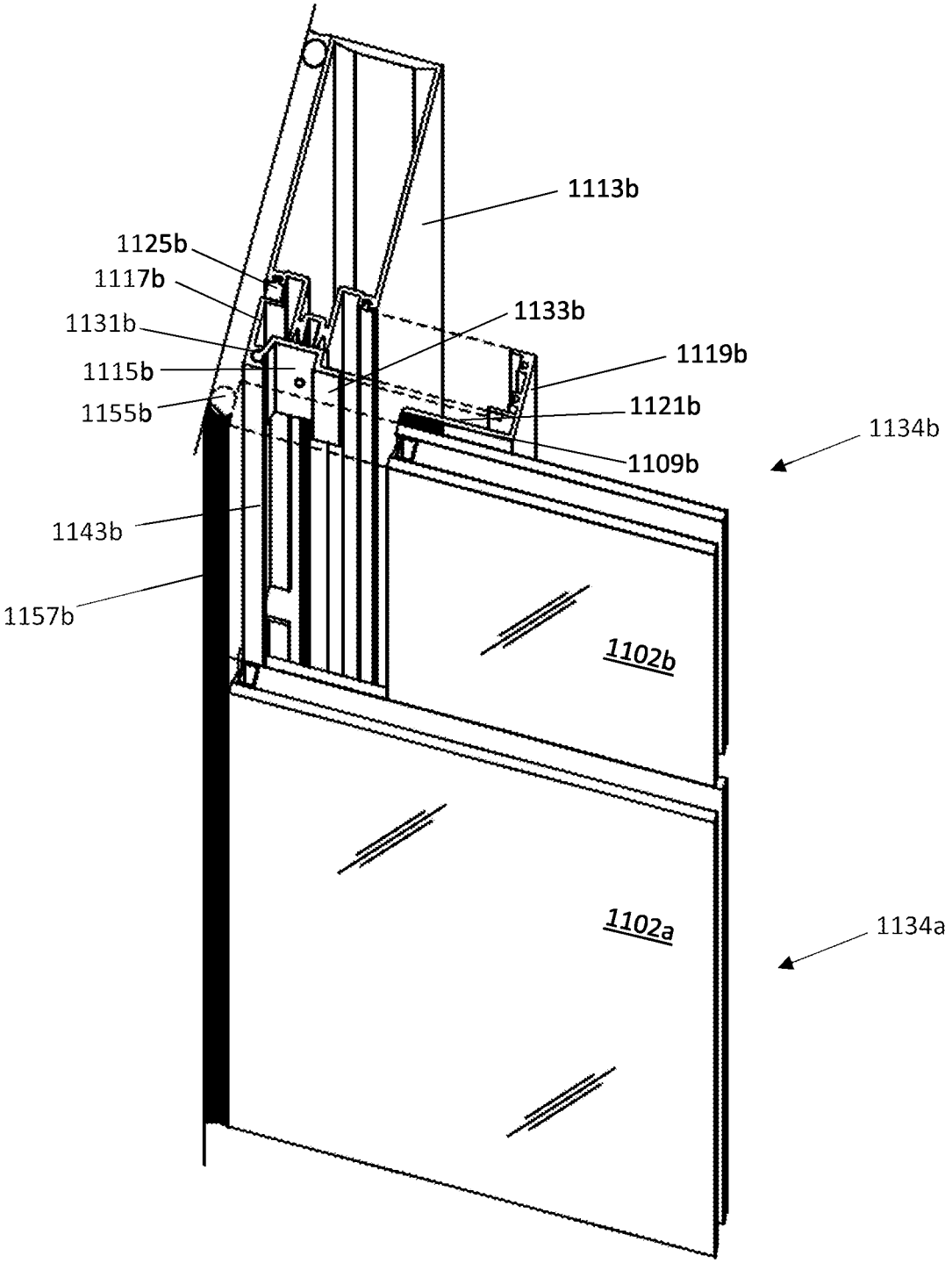
FIG. 14 is an isometric view of a glass-to-edge cassette framing assembly at a perimeter of a curtainwall structure according to embodiments of the present disclosure.

FIG. 14 shows an isometric view of two cassette frame units 1134*a*, 1134*b*, including glass paneling 1102*a*, 1102*b*, respectively, being installed at a vertical mullion 1113*b*, providing an isometric view of jamb assembly 1100*b*. As shown, the glass paneling 1102*a* extends to the perimeter structure, i.e., the sealant fill 1157*b*, of the installed assembly, passing in front of the cassette frames 1117*b*, 1119*b* and the mullion 1113*b*. FIG. 14 further shows that outer cassette frame 1117*b* can be pre-loaded at the vertical mullion 1113*b* and the jamb structure comprised of at least one backer rod 1155*b*. The first end 1143*b* of the outer cassette frame 1117*b* is visible, extending vertically for the length of the cassette frame. The anchoring member 1115*b* defines a first end 1131*b*, which is pivotably and slidably coupled to the first end 1143*b* of the cassette frame 1117*b*. Opposite the first end 1131*b*, the second end 1133*b* of the anchoring member 1115*b* is positioned to receive and couple with the inner cassette frame 1119*b*, which defines an elongate end portion 1121*b*. The elongate end portion 1121*b* extends in front of, i.e., exterior to, the anchoring member 1115*b*, and thus cassette frame 1117*b* and the majority of cassette frame 1119*b*, such that the glass panels 1102*b* coupled thereto also pass in front of the cassette frames, effectively concealing the cassette frames from a viewpoint exterior to the structure. Fixed to the elongate portion 1121*b* of the inner cassette frame 1119*b* via the layer of structural silicone and/or VHB™ tape (sold by 3M™) 1109*b*, the glass panels 1102*b* are slid to the perimeter of the curtainwall opening, where they can be positioned flush with the outer perimeter edge ("glass-to-edge").

Figure 15:
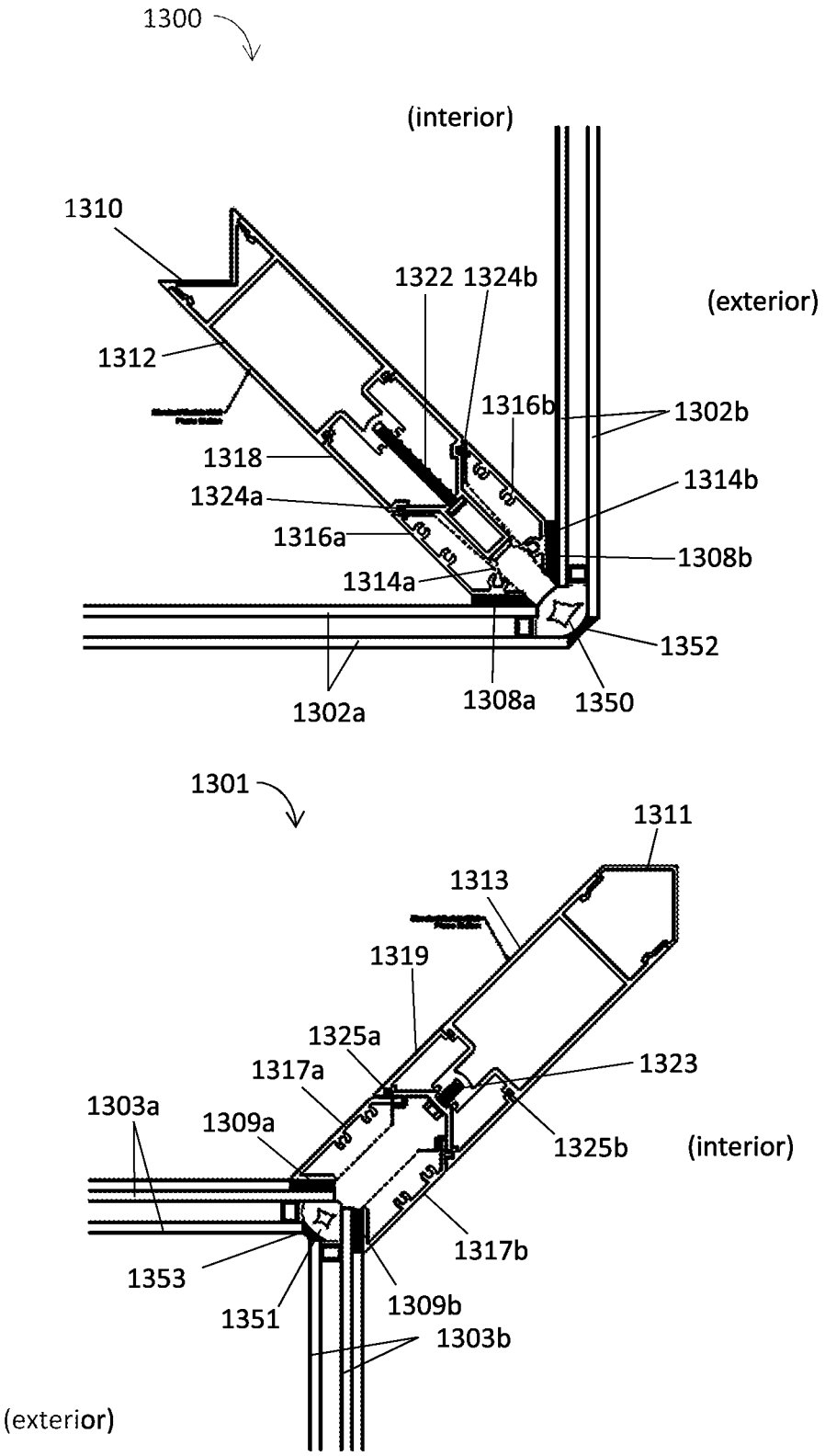
FIG. 15 is a sectional view of two corner cassette frame assemblies after installation according to embodiments of the present disclosure.

FIG. 15 shows embodiments of corner cassette frames after installation. The first cassette frame assembly 1300 is installed inside a 90° corner, and the second cassette frame assembly 1301 is installed outside a 90° corner. The same or similar methods of anchoring and installing the framing assemblies shown in FIGS. 1-14 can be applied to anchor and install the corner cassette assemblies shown in FIG. 15. For example, the dead weight of each corner assembly can be supported from below by one or more sill anchoring members.

The first cassette frame assembly 1300 is coupled with a vertical mullion 1312 that defines a concave inner portion 1310. The mullion 1312 is coupled with an inner cassette frame 1318, which may be pre-loaded in some embodiments. A first outer cassette frame 1316*a* is coupled with the inner cassette frame 1318, with a recessed gasket 1324*a* sealing the interface between the two components. The first outer cassette frame 1316*a* is coupled with an anchoring member 1314*a*. In embodiments, the anchoring member 1314*a* can be pivotably and/or slidably coupled with the cassette frame 1316*a*, thus allowing the anchoring member 1314*a* to be moved prior to securing the member with the inner cassette frame 1318 and mullion 1312 via fastener member 1322. The first outer cassette frame 1316*a* is attached to a first pair of glass panels 1302*a* via a layer of structural silicone and/or VHB™ tape 1308*a*. Perpendicular to the first glass panels 1302*a*, a second pair of glass panels 1302*b* is attached to a second outer cassette frame 1316*b* via a layer of structural silicone and/or VHB™ tape 1308*b*. The second outer cassette frame 1316*b* is coupled, via another recessed gasket 1324*b*, to the inner cassette frame 1318, which provides a tubular structure configured to extend the coupling portion of the mullion 1312 toward the intersection of the glass panels 1302*a*, 1302*b*, such that an elongated fastener 1322 may be required to secure the outer cassette frames 1316*a*, 1316*b* to the vertical mullion 1312. A seal member 1350 is positioned between the edges of the glass panels 1302*a*, 1302*b*. The outer glass panel of each pair may extend a greater distance than the inner panel, such that the opposing outer glass panels are separated only by a layer of sealant fill 1352. Accordingly, the glass panels comprising the corner assembly 1300 may extend to the edge of the sealing structure at the corner, passing in front of the cassette frames and mullion of the assembly 1300 in an aesthetically pleasing and architecturally sealed glass-to-edge configuration.

The second cassette frame assembly 1301 is coupled with a vertical mullion 1313 that defines a convex inner portion 1311. The mullion 1313 is coupled with an inner cassette frame 1319, which may be pre-loaded and secured to the mullion by a fastener 1323 in some examples. A first outer cassette frame 1317*a* is coupled with the inner cassette frame 1319, with a recessed gasket 1325*a* sealing the interface between the two components. A second outer cassette frame 1317*b* is also coupled with the inner cassette frame 1319, with a second recessed gasket 1325*b* sealing the interface therebetween. The first outer cassette frame 1317*a* is attached to a first pair of glass panels 1303*a* via a layer of structural silicone and/or VHB™ tape 1309*a*. Perpendicular to the first glass panels 1303*a*, a second pair of glass panels 1303*b* is attached to the second outer cassette frame 1317*b* via another layer of structural silicone and/or VHB™ tape 1309*b*. A seal member 1351 is positioned between the ends of the glass panels 1303*a*, 1303*b*. The inner glass panel of each pair may extend a greater distance than the outer panel, such that the opposing outer glass panels are separated only by a layer of sealant fill 1353. The glass panels comprising the corner assembly 1301 thus extend to the edge of the sealing structure at the corner, passing in front of the cassette frames and mullion of the assembly 1301 in a glass-to-edge configuration.

Although the present disclosure provides references to preferred embodiments, persons skilled in the art will recognize that changes may be made in form and detail without departing from the spirit and scope of the invention. For example, the framing assemblies disclosed herein for curtainwall applications can also be applied to door frame inserts, sun shade support brackets, and/or captured vertical covers. The Detailed Description should be read with reference to the drawings. The drawings show, by way of illustration, specific embodiments in which the present curtainwall assemblies and related methods of installation can be practiced. These embodiments are also referred to herein as "examples."

Certain terms are used throughout this patent document to refer to particular features or components. As one skilled in the art will appreciate, different people may refer to the same feature or component by different names. This patent document does not intend to distinguish between components or features that differ in name but not in function. For the following defined terms, certain definitions shall be applied unless a different definition is given elsewhere in this patent document. The terms "a," "an," and "the" are used to include one or more than one, independent of any other instances or usages of "at least one" or "one or more." The term "or" is used to refer to a nonexclusive or, such that "A or B" includes "A but not B," "B but not A," and "A and B." All numeric values are assumed to be modified by the term "about," whether or not explicitly indicated. The term "about" refers to a range of numbers that one of skill in the art considers equivalent to the recited value (i.e., having the same function or result). In many instances, the term "about" can include numbers that are rounded to the nearest significant figure. The recitation of numerical ranges by endpoints includes all numbers and sub-ranges within and bounding that range (e.g., 1 to 4 includes 1, 1.5, 1.75, 2, 2.3, 2.6, 2.9, etc. and 1 to 1.5, 1 to 2, 1 to 3, 2 to 3.5, 2 to 4, 3 to 4, etc.).

What is claimed is:

1. A curtainwall assembly comprising:

a mullion;

a first cassette frame coupled to a front end of the mullion via a first anchoring tab;

a second cassette frame coupled to the front end of the mullion via a second anchoring tab;

a first glass panel fixed to the first cassette frame; and a second glass panel fixed to the second cassette frame, wherein at least one of the first and second anchoring tabs is configured to pivot about a pivot point defined by the first or second cassette frame prior to installation.

2. The curtainwall assembly of claim 1, wherein the second anchoring tab is configured to move by sliding along a longitudinal track defined by the second cassette frame prior to installation.

3. The curtainwall assembly of claim 1, wherein the first anchoring tab is configured to move by sliding along a longitudinal track defined by the first cassette frame prior to installation.

4. The curtainwall assembly of claim 1, wherein the pivot point is defined by a longitudinal track defined by the first or second cassette frame.

5. The curtainwall assembly of claim 1, wherein the first and second glass panels are separated by a seal member positioned therebetween.

6. The curtainwall assembly of claim 1, wherein a first gasket seals a first interface between the first cassette frame and the mullion, and a second gasket seals a second interface between the second cassette frame and the mullion.

7. The curtainwall assembly of claim 1, wherein the first and second glass panels each comprise two parallel panes of vision glass.

8. The curtainwall assembly of claim 1, further comprising a fastener member configured to secure the first and second anchoring tabs to the mullion.

9. The curtainwall assembly of claim 1, wherein the mullion comprises a vertical mullion.

10. A method of installing a cassette frame assembly, the method comprising:

securing a lower cassette frame to a horizontal mullion via an anchoring member, wherein a lower glass panel is fixed to the lower cassette frame; and rolling an upper cassette frame onto the anchoring member, wherein an upper glass panel is fixed to the upper cassette frame, and wherein the upper cassette frame defines a coupling end configured to couple with the anchoring member.

11. The method of claim 10, wherein the anchoring member is configured to pivot and slide within a lateral track defined by the lower cassette frame.

12. The method of claim 11, wherein the lateral track extends along a length of the lower cassette frame and defines an arcuate cross section.

13. The method of claim 10, wherein the anchoring member is configured to provide dead-load support for the upper cassette frame and the upper glass panel during an installation.

14. The method of claim 10, wherein the upper and lower glass panels are positioned within one column of a cassette frame structure after installation.

15. A method of installing a cassette frame assembly, the method comprising:

securing a first cassette frame to a horizontal mullion via a first anchoring tab, wherein the first cassette frame is fixed to a first glass panel;

aligning a second cassette frame with the first cassette frame, wherein the second cassette frame is fixed to a second glass panel and coupled with a second anchoring tab;

repositioning at least one of the first or second anchoring tabs prior to securing the first and second cassette frames to the horizontal mullion, wherein repositioning comprises pivoting at least one of the first or second anchoring tabs within a track defined by at least one of the first or second cassette frames; and securing the second cassette frame to the horizontal mullion.

16. The method of claim 15, wherein repositioning further comprises sliding at least one of the first or second anchoring tabs in a lateral direction along the track defined by at least one of the first or second cassette frames.

17. The method of claim 15, wherein at least one of the first and second anchoring tabs is pivotable between an engaged position and a disengaged position, wherein in the engaged position, a free end defined by the anchoring tab is aligned with an aperture of the horizontal mullion configured to receive a fastener member.

18. A method of installing a cassette frame assembly, the method comprising:

securing a first cassette frame to a vertical mullion via a first anchoring tab, wherein the first cassette frame is fixed to a first glass panel;

aligning a second cassette frame with the first cassette frame, wherein the second cassette frame is fixed to a second glass panel and coupled with a second anchoring tab;

pivoting the second anchoring tab within a track defined by the second cassette frame; and securing the second cassette frame to the vertical mullion.

19. The method of claim 18, further comprising sliding at least one of the first or second anchoring tabs in a vertical direction prior to securing at least one of the first and second cassette frames to the vertical mullion.

20. A cassette frame assembly comprising:

a cassette frame;

a glass panel fixed to the cassette frame; and at least one anchoring member coupled with and pivotable, slidable, or both relative to the cassette frame, wherein the anchoring member is configured to couple the cassette frame with a mullion, wherein after an installation process, the glass panel is positioned in front of the cassette frame at a perimeter structure of the cassette frame assembly, such that the glass panel extends to an edge of the perimeter structure.

21. The cassette frame assembly of claim 20, wherein the perimeter structure comprises a head structure, a jamb structure, or a sill structure of a curtainwall structure.

22. The cassette frame assembly of claim 21, wherein the perimeter structure further comprises sealant fill.

23. The cassette frame assembly of claim 20, wherein the mullion is a vertical mullion or horizontal mullion of a curtainwall structure.

* * * * *